US007485046B2

(12) United States Patent
Dekker

(10) Patent No.: US 7,485,046 B2
(45) Date of Patent: Feb. 3, 2009

(54) APPARATUS FOR ROPEBOARDING

(76) Inventor: Andrew Dekker, 750 Erinbrook Drive, Unit 6, Kitchener, Ontario (CA) N2E 2S7

( * ) Notice: Subject to any disclaimer, the term of this patent is extended or adjusted under 35 U.S.C. 154(b) by 696 days.

(21) Appl. No.: 11/041,633

(22) Filed: Jan. 25, 2005

(65) Prior Publication Data

US 2006/0197330 A1 Sep. 7, 2006

(51) Int. Cl.
*A63G 23/00* (2006.01)
*A63G 13/00* (2006.01)

(52) U.S. Cl. ..... 472/135; 482/34

(58) Field of Classification Search ..... 472/118, 472/121, 122, 135; 482/34, 146
See application file for complete search history.

(56) References Cited

U.S. PATENT DOCUMENTS

| | | | | |
|---|---|---|---|---|
| 3,525,522 | A * | 8/1970 | Piller | 482/80 |
| 3,593,708 | A | 7/1971 | Steele | |
| 3,854,739 | A | 12/1974 | Toda et al. | |
| 4,046,375 | A * | 9/1977 | Lelong | 472/14 |
| 4,073,500 | A | 2/1978 | Campeau | |
| 4,289,325 | A | 9/1981 | Whitacre | |
| 4,986,784 | A * | 1/1991 | French | 441/65 |
| 5,046,747 | A | 9/1991 | Nielsen, Jr. | |
| 5,178,590 | A | 1/1993 | Stephens | |
| 5,330,399 | A | 7/1994 | Fan | |
| 5,580,317 | A | 12/1996 | Yun | |
| 6,042,439 | A | 3/2000 | Parten | |
| 6,089,592 | A | 7/2000 | Negus | |
| 6,319,135 | B1 | 11/2001 | Monson | |
| 6,575,114 | B2 * | 6/2003 | Sandler et al. | 114/315 |
| 6,651,776 | B2 * | 11/2003 | Montecer, Jr. | 182/196 |
| 6,932,710 | B1 * | 8/2005 | Hartin | 472/118 |
| 2004/0195795 | A1 | 10/2004 | Huang | |

FOREIGN PATENT DOCUMENTS

| | | |
|---|---|---|
| JP | 9327539 | 12/1997 |

* cited by examiner

*Primary Examiner*—Kien T Nguyen
(74) *Attorney, Agent, or Firm*—Bereksin & Parr

(57) ABSTRACT

A ropeboard apparatus includes a ropeboard, and a support rope for hanging the ropeboard from an elevated structure. The ropeboard comprises an elongated platform having a longitudinal platform axis and a top surface shaped for a user to stand thereon, and a coupler for rotatably coupling the platform to the support rope so that the platform can be rotated about its longitudinal axis. The ropeboard apparatus may also include a spunk or universal joint for attaching the support rope to the structure, and a handle attached to the support rope at a location above the ropeboard. The coupler may comprise a shaft rigidly connected to the platform and oriented along the longitudinal axis, and a connector rotatably coupled to the shaft for connecting the platform to the support rope. The subject ropeboard apparatus is a new recreational and sporting apparatus that facilitates the performance of an extreme sport involving stunts and tricks.

21 Claims, 8 Drawing Sheets

APPARATUS FOR ROPEBOARDING

FIELD OF THE INVENTION

The present invention relates to apparatus for recreational and sporting activities, and in particular, to apparatus for extreme board sports that involve stunts and tricks.

BACKGROUND OF THE INVENTION

Board sports are a popular form of sporting and recreational activity. Examples of board sports are skateboarding, snowboarding and wakeboarding. These board sports typically employ boards with flat bottoms that slide over surfaces or boards with wheels that roll on flat surfaces. For example, snowboards slide on snow, and skateboards have wheels which roll over generally flat surfaces. In the case of both types of boards, the boards are supported by the surfaces over which they slide or roll.

Prior art apparatus for the aforesaid board sports have certain requirements. Typically a large area is required to perform these sports. Snowboards require a ski hill, wakeboards require a body of water, and skateboards require roads or sidewalks. Prior art board sports also typically require an external motive force, such as the force of gravity provided by a ski hill, or a motor boat, to move the board.

Additionally, if participants wish to perform jumps or stunts that require "air", they need to elevate the board from the surface supporting the board. These stunts are often done on structures such as ramps, pipes, rails, etc., which help users propel the boards to higher elevations or otherwise facilitate the performance of such stunts. These structures are typically found in skateboard parks and snowboard areas.

These requirements limit the use of existing board sport apparatus, and in particular, it is generally not practical to perform the aforesaid board sports in a limited area such as a backyard, or without the use of an external motive force or large, expensive structures.

Accordingly, there is a need for apparatus for a new extreme board sport that does not have the aforesaid requirements or limitations.

SUMMARY OF THE INVENTION

The present invention is directed to apparatus for ropeboarding, comprising a support rope for attachment to an elevated structure, and a ropeboard comprising an elongated platform having a longitudinal platform axis and a top surface shaped for a user to stand thereon, and a coupler for rotatably coupling the platform to the support rope so that the platform can be rotated about the longitudinal platform axis. The ropeboard apparatus preferably comprises attachment means for attaching the support rope to the elevated structure, and a handle attached to the support rope at a location above the ropeboard. The attachment means preferably comprises swivel means such as a universal joint for enabling the rope to swivel about a longitudinal rope axis.

Another aspect of the present invention is a ropeboard comprising an elongated platform having a longitudinal platform axis and a top surface shaped for a user to stand thereon, and a coupler for rotatably coupling the platform to the support rope so that the platform can be rotated about the longitudinal platform axis. The coupler preferably comprises a shaft rigidly connected to the platform and oriented along the longitudinal platform axis, and a connector rotatably coupled to the shaft for connecting the platform to the support rope. The connector preferably comprises a bearing portion mounted on the shaft and a rope connecting portion shaped for receiving the support rope.

BRIEF DESCRIPTION OF THE DRAWINGS

The invention will now be described, by way of example only, with reference to the following drawings, in which.

DETAILED DESCRIPTION OF THE INVENTION

Figure 1:
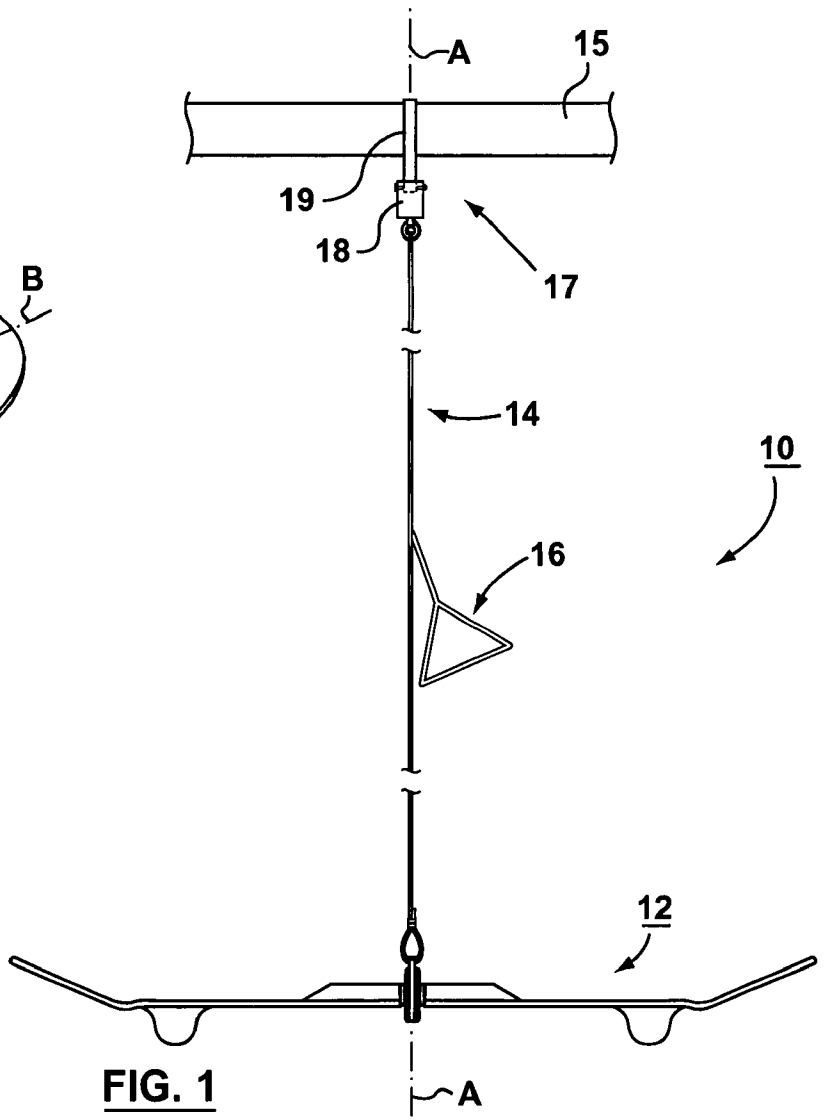
FIG. 1 is a side view of ropeboard apparatus made in accordance with a preferred embodiment of the present invention.

Referring to FIG. 1, illustrated therein is ropeboard apparatus 10 made in accordance with a preferred embodiment of the subject invention. Ropeboard apparatus 10 comprises ropeboard 12, support rope 14, handle 16, and attachment means 17 for attaching the support rope 14 to an elevated structure 15 capable of supporting the weight of a user and ropeboard apparatus 10. Elevated structure 15 should be sufficiently elevated so as to allow a user standing on ropeboard 12 to accomplish swinging movements. For indoor use, elevated structure 15 could comprise the ceiling structure of a gymnasium or other large room, and for outdoor use, elevated structure 15 could comprise tree branches, cranes or poles.

Support rope 14 serves to support the weight of the user and ropeboard 12, and may take the form of a rope, cable, cord, or the like. Support rope 14 is attached at one end to attachment means 17 and at the other end to ropeboard 12. Support rope 14 is of a length suitable to suspend ropeboard 12 at a distance from the ground sufficient to prevent ropeboard 12 from touching the ground when ropeboard 12 swings away from the vertical. Ropeboard 12 is preferably suspended about 2 feet off the ground, so that a user can jump from the ground onto the ropeboard 12 without assistance.

Handle 16 assists a user to stay on ropeboard 12 while performing stunts and tricks. Handle 16 is attached to the support rope 14 at a selected distance, preferably about 4 feet above ropeboard 12, so as to position handle 16 at the chest level of the user when the user is standing on ropeboard 12. Handle 16 is preferably adjustable so that handle 16 can be affixed to support rope 14 at different positions above ropeboard 12 to accommodate users of different heights.

Attachment means 17 preferably comprises swivel means 18 that permits ropeboard 12 to rotate about the longitudinal axis A of support rope 14 without tangling support rope 14, and sling 19 for securing swivel means 18 to elevated structure 15.

Figure 2:
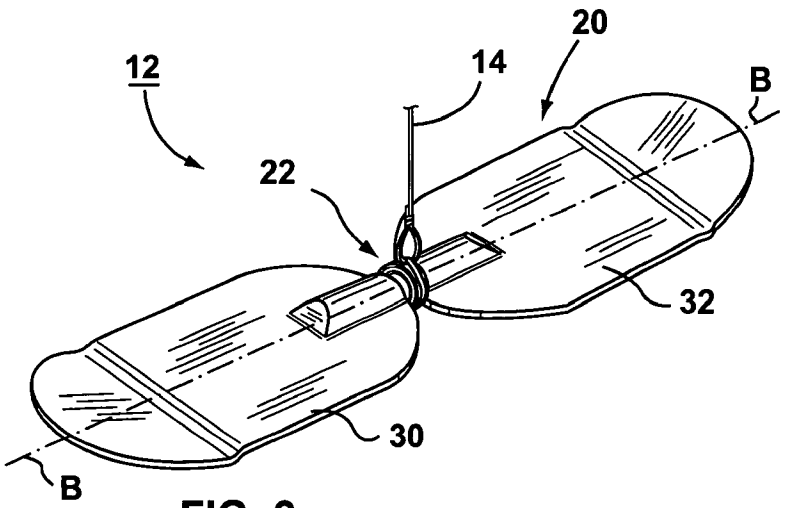
FIG. 2 is a perspective view of a ropeboard made in accordance with a preferred embodiment of the present invention.
Figure 3:
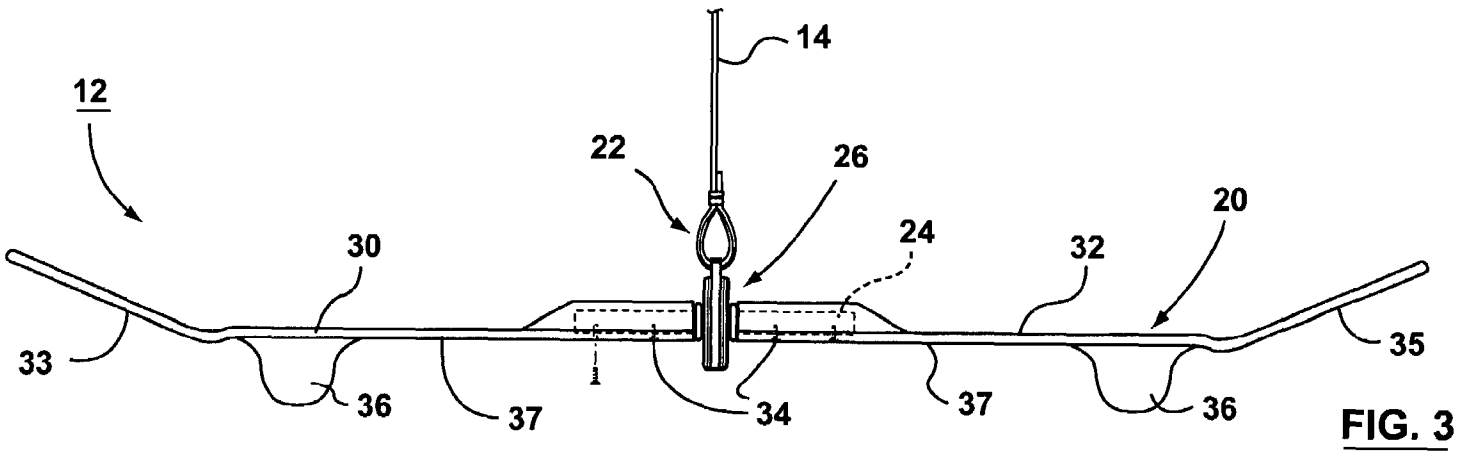
FIG. 3 is a side view of the ropeboard shown in FIG. 2.
Figure 4:
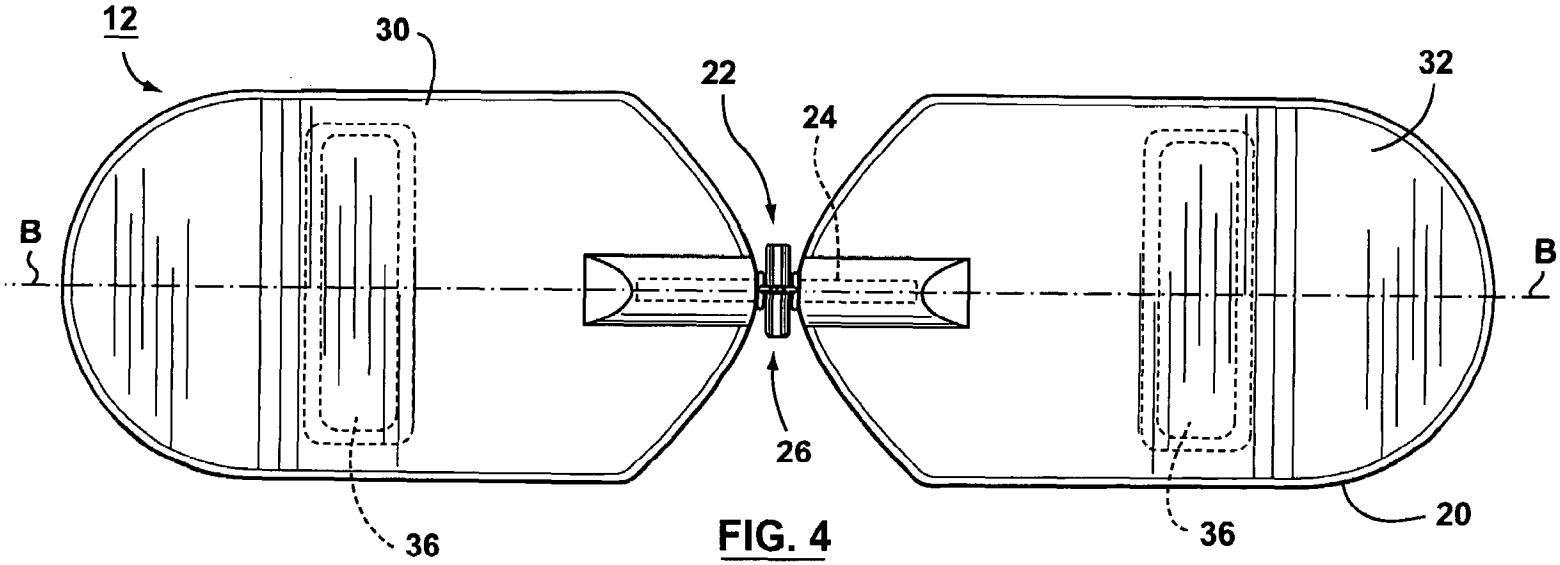
FIG. 4 is a top plan view of the ropeboard shown in FIG. 2.

Referring now to FIGS. 2 to 4, illustrated therein is ropeboard 12 made in accordance with a preferred embodiment of the subject invention. Ropeboard 12 comprises an elongated platform 20 having a longitudinal platform axis B and a top surface shaped for a user to stand thereon, and a coupler 22 for rotatably coupling platform 20 to support rope 14 so that platform 20 can be rotated about the longitudinal platform axis B of ropeboard 12. Coupler 22 comprises shaft or axle 24 and connector 26 that rotates about shaft 24 for connecting platform 20 to support rope 14. Shaft 24 is rigidly connected to platform 20 and oriented along the longitudinal platform axis B, preferably at the center of gravity of platform 20 so that ropeboard 12 is suspended in a generally horizontal plane in its rest position. Shaft 24 is preferably a cylindrical metal tube.

Elongated platform 20 of ropeboard 12 preferably comprises a front board portion 30 and a back board portion 32, with shaft 24 connecting front board portion 30 to back board portion 32. Board portions 30, 32 have generally flat middle portions, and angled end portions 33, 35 that facilitate the performance of stunts and tricks. Ropeboard 12 is assembled by inserting shaft 24 into bores in board portions 30, 32, and affixing board portions 30, 32 to shaft 24 using fasteners such as screws 34. Board portions 30, 32 preferably comprise a foam or wood core portion covered with fiberglass or carbon fiber.

As best shown in FIGS. 3 and 4, ropeboard 12 preferably includes trucks 36 extending downwardly from the bottom surfaces 37 of board portions 30, 32. Trucks 36 help the user to perform stunts such as landing and grinding on rails. Trucks 36 are preferably made of solid fiberglass.

Figure 6:
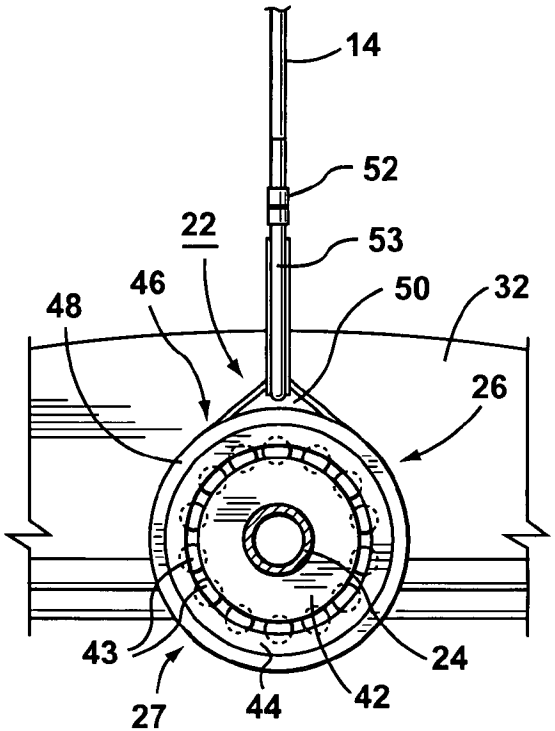
FIG. 6 is a sectional view taken along line 6-6 in FIG. 5.
Figure 5:
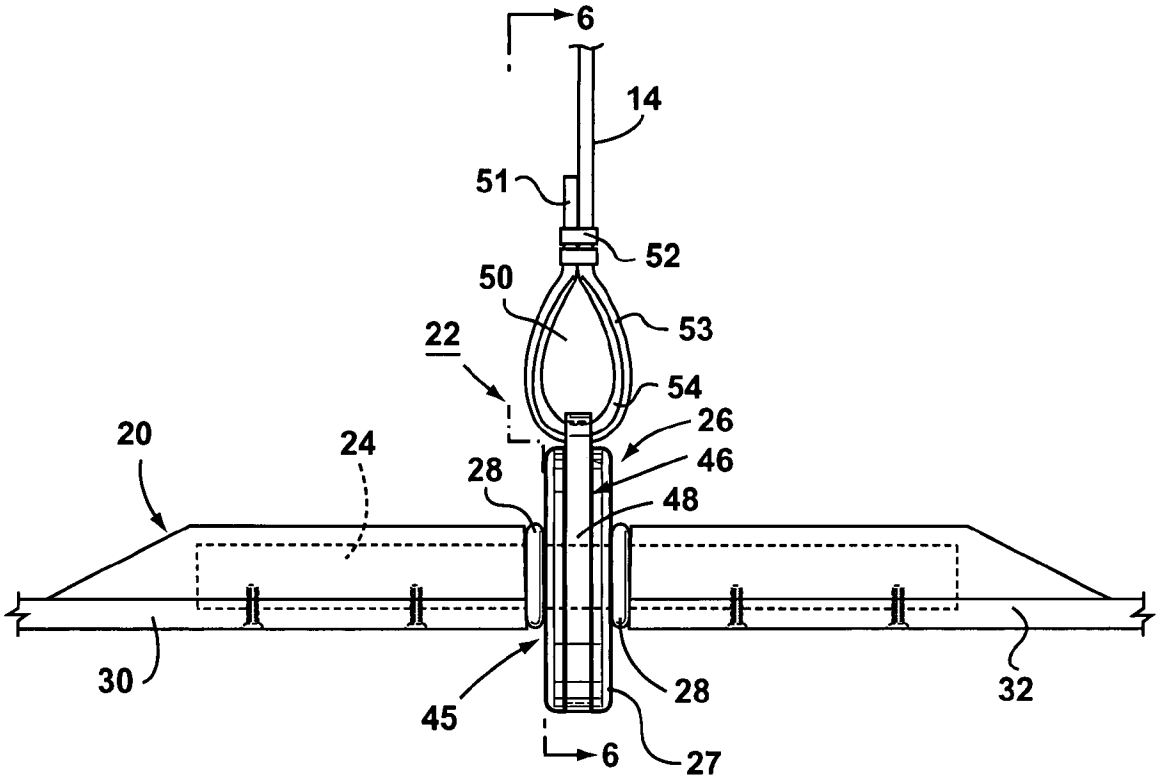
FIG. 5 is a detailed side view of a portion of the subject ropeboard having a coupler made in accordance with a first embodiment of the present invention.

FIGS. 5 and 6 provide detailed views of coupler 22 made in accordance with a first embodiment of the present invention. Connector 26 of coupler 22 comprises a bearing portion 45 including ball bearing 27 and washers 28, and a rope connector portion 46. Ball bearing 27 has an inside race 42 rigidly secured to shaft 24, an outside race 44, and balls 43. Races 42, 44 have opposed arcuate surfaces shaped to receive balls 43 and allow races 42, 44 to rotate freely relative to each other. Rope connecting portion 46 is preferably a sleeve 48 rigidly secured to outside race 44, having an aperture 50 shaped for receiving support rope 14. Support rope 14 is preferably connected to ball bearing 27 by inserting end 51 of support rope 14 through aperture 50 and forming a permanent loop 53 using a fastening means such as a ferrule 52. Alternatively, rope connecting portion 46 could be attached to support rope 14 using a u-bolt, knot or other fastening means. Optionally a metal or plastic half sleeve 54 is attached to loop 53 to prevent wear of support rope 14.

Figure 8:
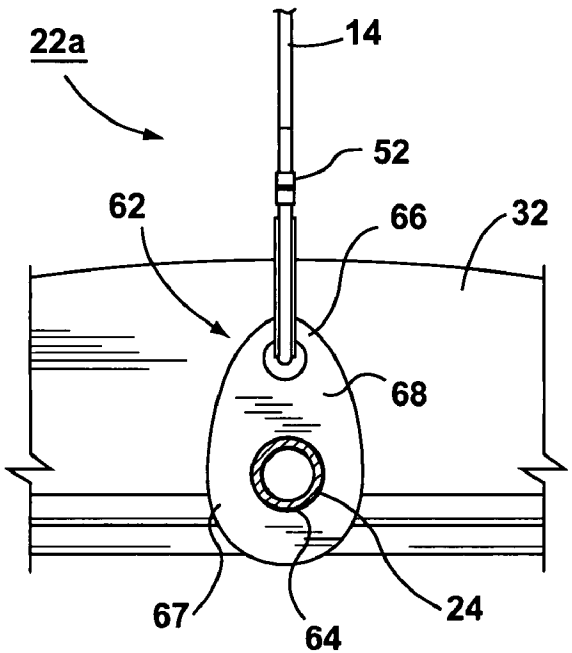
FIG. 8 is a sectional view taken along line 8-8 in FIG. 7.
Figure 7:
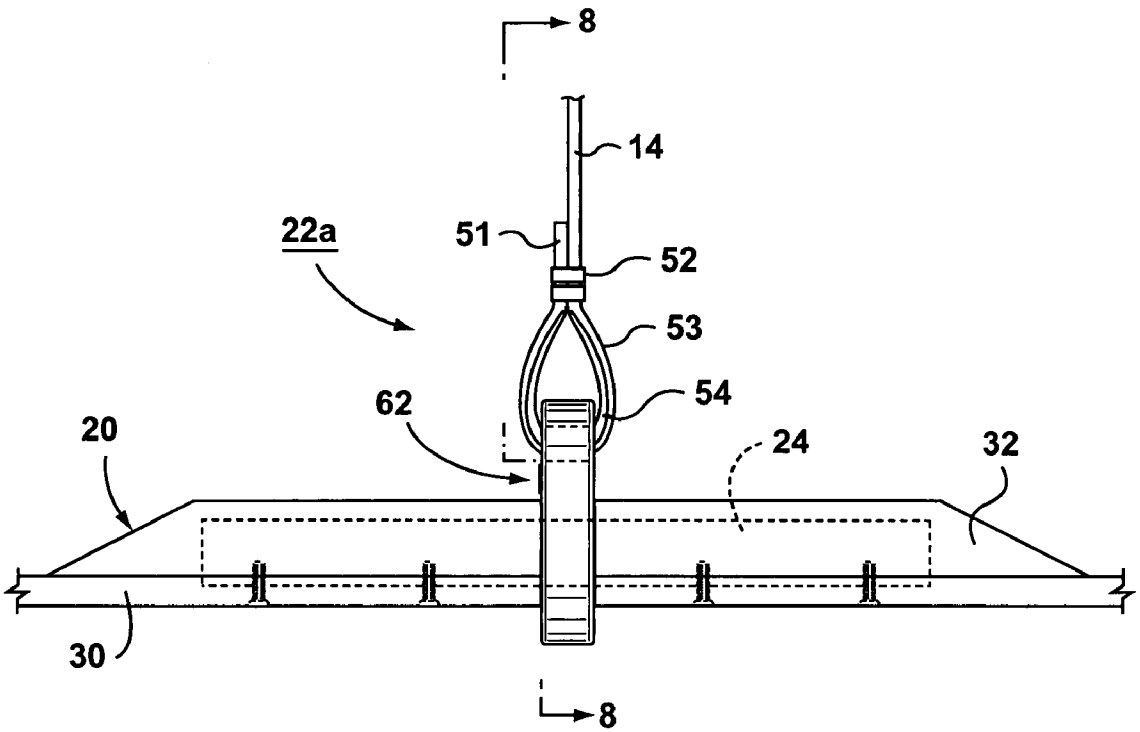
FIG. 7 is a detailed side view of a portion of a ropeboard having a coupler made in accordance with an second embodiment of the present invention.

FIGS. 7 and 8 provide detailed views of a second embodiment of the coupler of the present invention. Coupler 22*a* comprises cylindrical shaft 24 extending between board portions 30, 32, and connector 62 rotatable about shaft 24 for connecting platform 20 to support rope 14. Connector 62 comprises a body made from Ultra High Molecular Weight (UHMW) polyethylene, Delrin, or other low coefficient of friction plastics designed for sliding applications between metal and plastic. Connector 62 comprises a bearing portion 67 and a rope connecting portion 68. Bearing portion 67 includes a shaft aperture 64 sized to permit shaft 24 to freely rotate within bearing portion 67 with low frictional resistance. Rope connecting portion 68 comprises an eccentric lobe having a rope aperture 66 sized to allow end 51 of support rope 14 to be looped therethrough and secured with a fastening means such as a ferrule 52 to form permanent loop 53. Optionally a metal or plastic half sleeve 54 is attached to the loop portion of support rope 14 to prevent wear of support rope 14.

Figure 9:
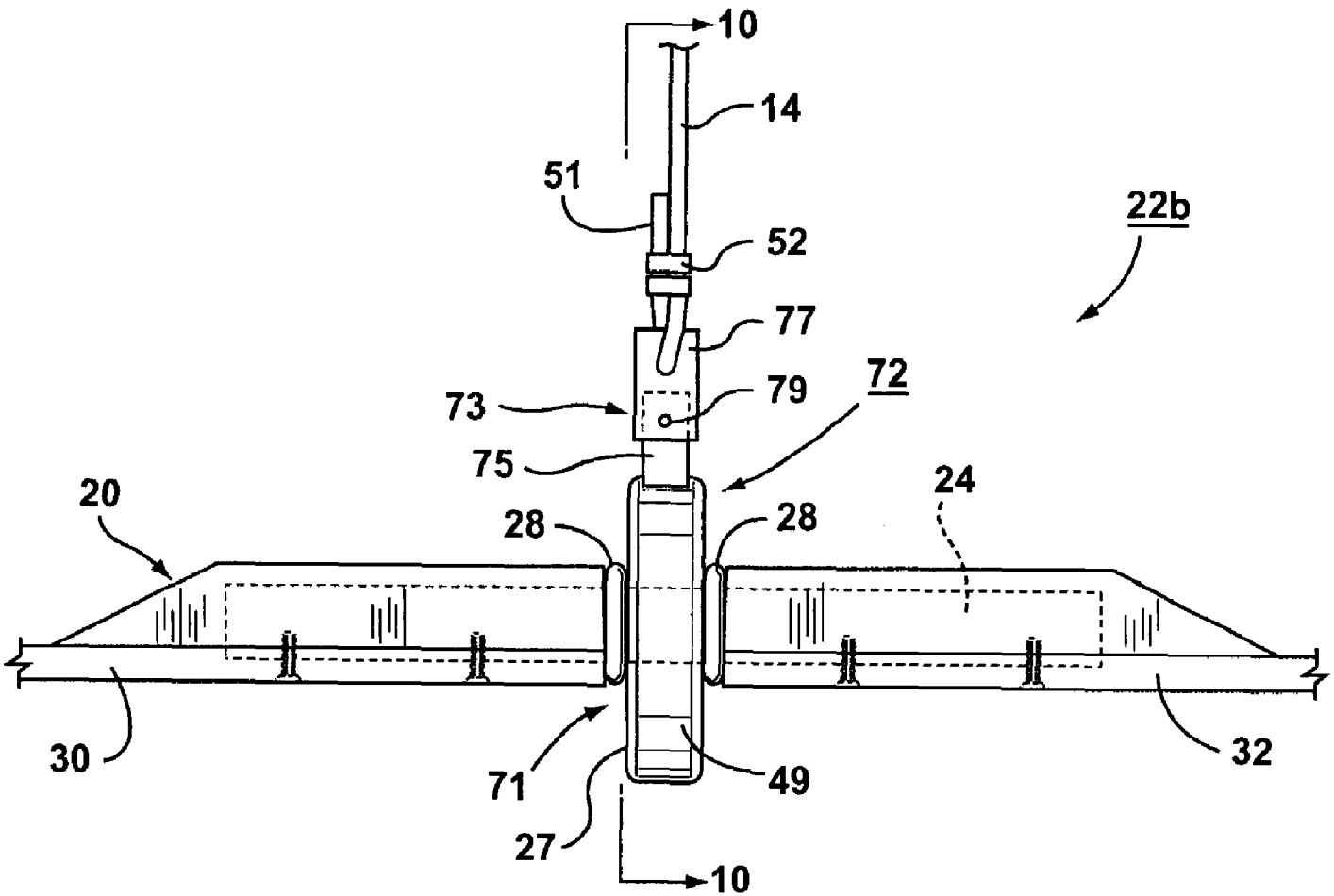
FIG. 9 is a detailed side view of a portion of a ropeboard having a coupler made in accordance with a third embodiment of the present invention.
Figure 10:
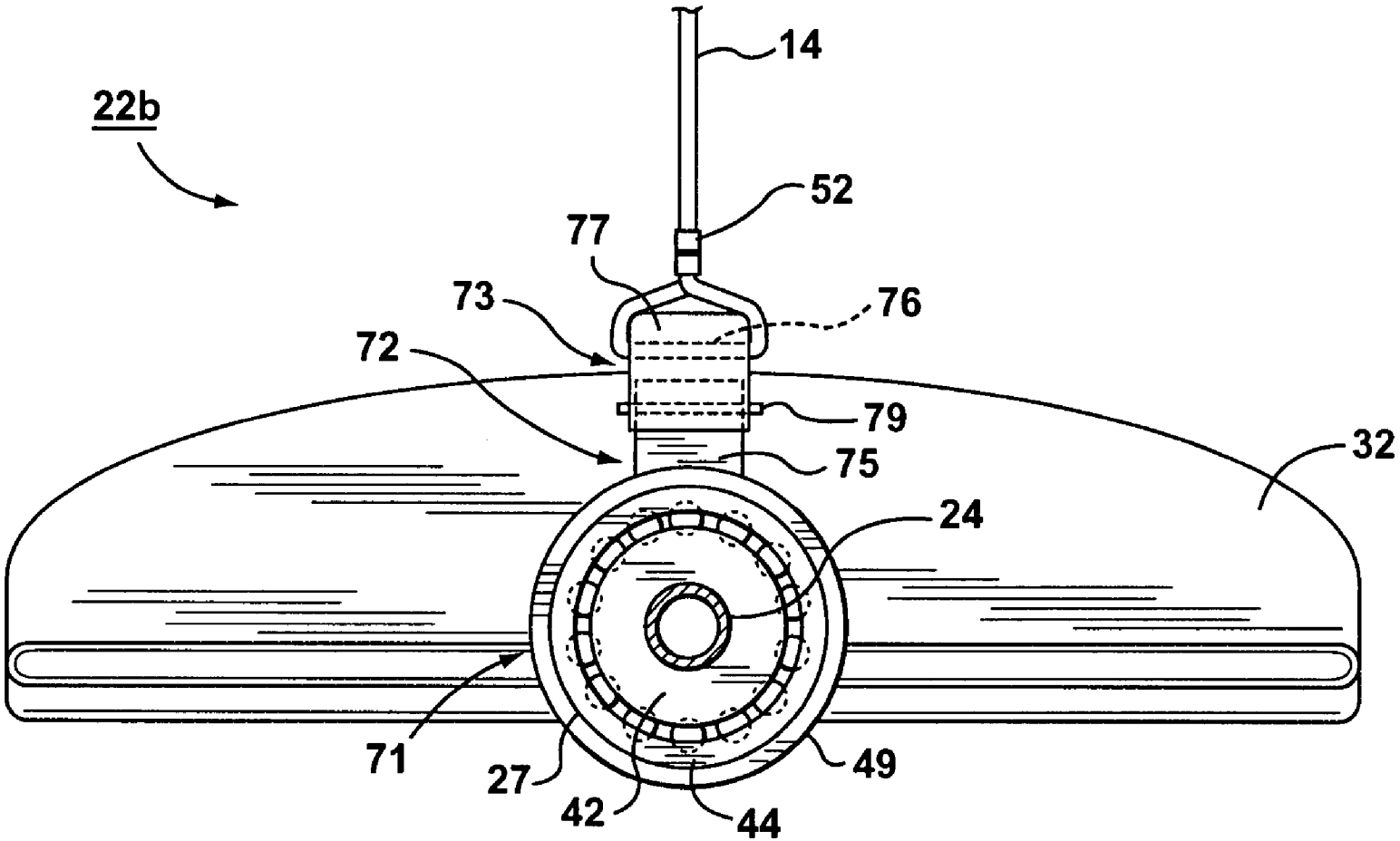
FIG. 10 is a sectional view taken along line 10-10 in FIG. 9.

FIGS. 9 and 10 provide detailed views of a third embodiment of the a coupler of the present invention. Coupler 22*b* comprises cylindrical shaft 24 extending between board portions 30, 32, and connector 72 rotatable about shaft 24 for connecting platform 20 to support rope 14. Connector 72 comprises a bearing portion 71 and rope connecting portion 73. Bearing portion 71 comprises ball bearing 27 and washers 28. Rope connecting portion 73 comprises a sleeve 49 rigidly secured to the outside race 44 of bearing 27 and a quick release, sliding tube type connector comprising an inner tubular member 75 extending from sleeve 49, an outer tubular member 77 connected to support rope 14, and a pin 79 that releasably secures outer tubular member 77 to inner tubular member 75. The inside surface of outer tubular member 77 is shaped to slidingly engage the outer surface of inner tubular member 75. Support rope 14 is connected to outer tube portion 77 by inserting depending end 51 and through aperture 76 with a fastening means such as a ferrule 52 to form a permanent loop. In this embodiment of a coupler 22b, ropeboard 12 can be easily disconnected from support rope 14 by removing pin 79 and sliding outer tubular member 77 from inner tubular member 75.

Figure 11:
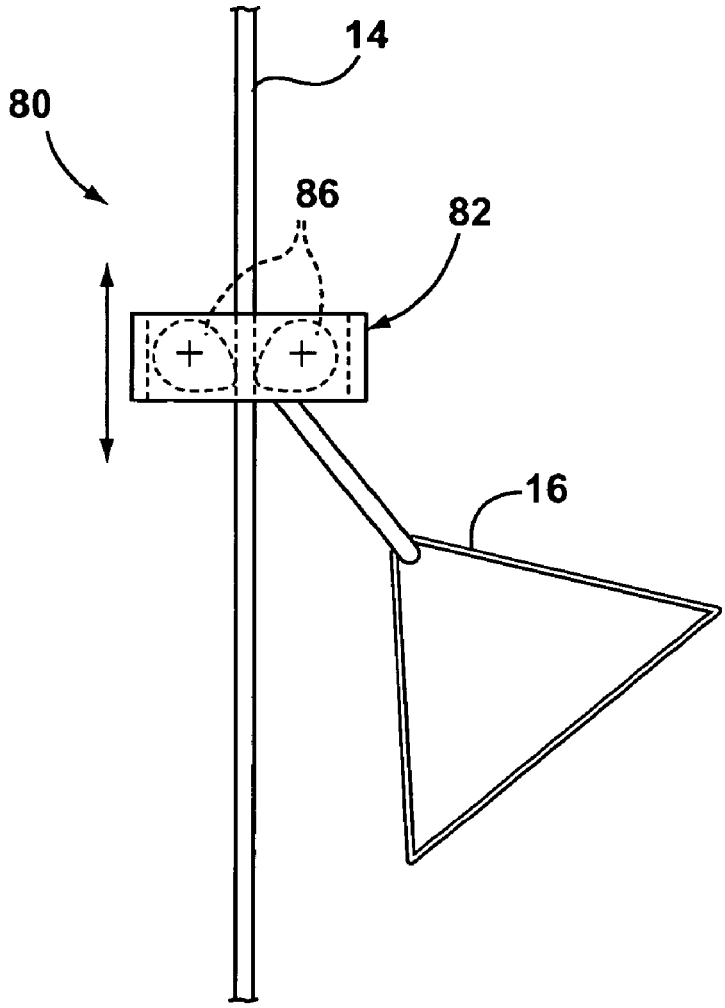
FIG. 11 is a detailed front view of a portion of the subject ropeboard apparatus showing a handle assembly made in accordance with the subject invention.
Figure 12:
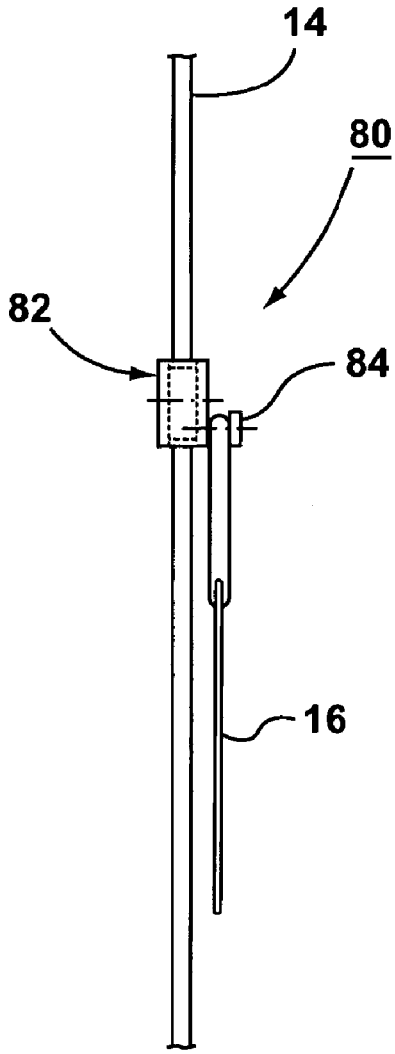
FIG. 12 is a side view of the handle assembly shown in FIG. 11.

Referring now to FIGS. 11 and 12, illustrated therein is handle assembly 80 made in accordance with a preferred embodiment of the invention. Handle assembly 80 comprises a handle 16, and adjustment means for adjustably connecting handle 16 to support rope 14. The adjustment means preferably takes the form of a cam wedge 82. Cam wedge 82 comprises two cams 86 that are positioned on either side of support rope 14 such that when downward pressure is exerted on cam wedge 82, cams 86 rotate to pinch support rope 14 so that cam wedge 82 is fixed at a selected position on support rope 14. Handle 16 is attached to cam wedge 82 by fastener 84 in a manner that allows handle 16 to move in any direction while attached to cam wedge 82. Handle assembly 80 may be moved to be fixed at different positions on support rope 14 by releasing cams 86.

Alternatively, handle 16 could be attached to support rope 14 using a u-bolt assembly or other fastening means.

Figure 13:
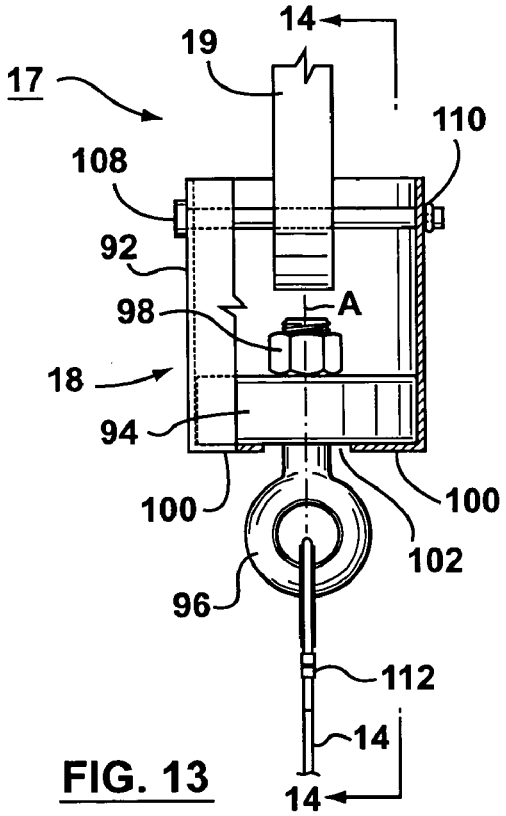
FIG. 13 is a detailed side view of the attachment means of the subject invention showing a portion of the housing cutaway.
Figure 15:
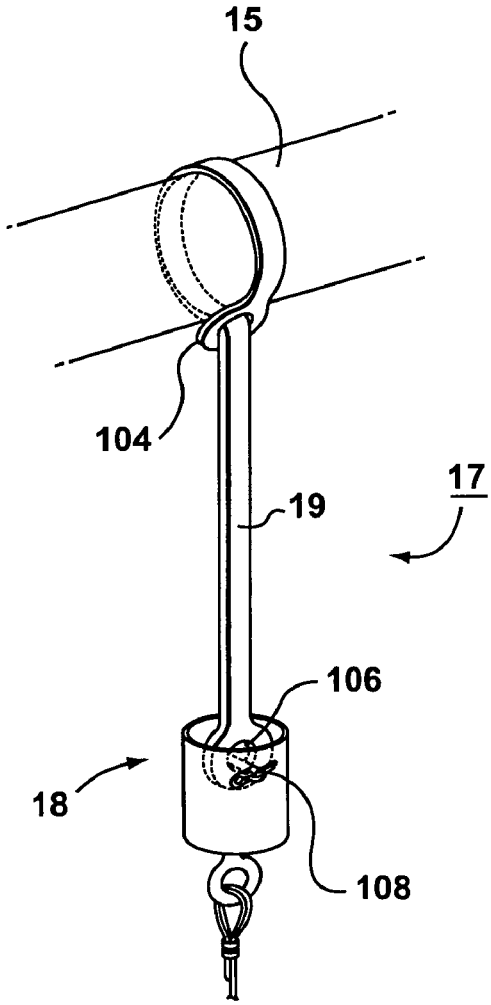
FIG. 15 is a perspective view of the attachment means shown attached to an elevated structure.
Figure 14:
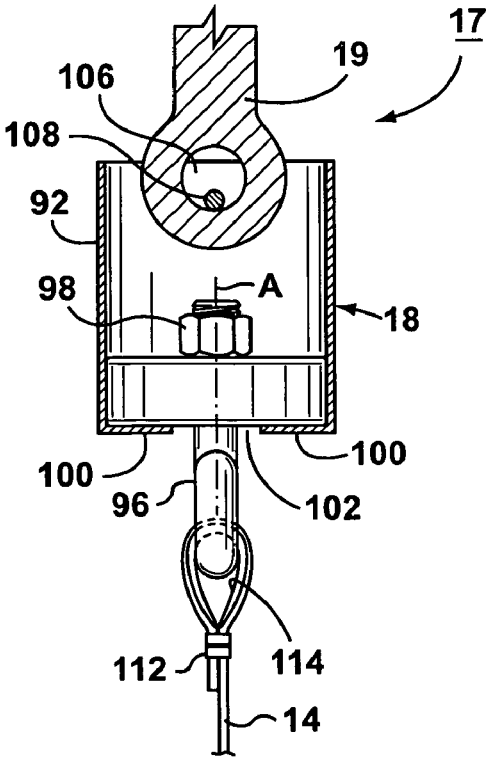
FIG. 14 is a sectional view of the attachment means taken along line 14-14 in FIG. 13.

Referring now to FIGS. 13 to 15, attachment means 17 preferably comprises swivel means 18 for enabling support rope 14 to swivel about longitudinal rope axis A, in the form of a spunk or a universal joint, and a sling 19 that secures swivel means 18 to elevated structure 15. The universal joint comprises a metal tube casing 92, a bearing 94, an eye bolt 96, and a nut 98. Metal tube casing 92 has a bottom flange 100 to support bearing 94 and a bottom opening 102 that permits eye bolt 96 to extend outside of metal tube casing 92. Eye bolt 96 is inserted into bearing 94 and secured on the top side inner race of bearing 94 by nut 98. Bearing 94 permits eye bolt 96 to be rotated relative to casing 92. Support rope 14 is connected to eye bolt 96 by looping support rope 14 through eye bolt 96, and forming a permanent loop with a fastening means such as ferrule 112, a knot or a u-bolt. Optionally a metal or plastic half sleeve 114 is attached to the loop portion of support rope 14 to prevent wear of support rope 14.

As illustrated in FIG. 15, sling 19 may be attached to elevated structure 15 by wrapping sling 19 around elevated structure 15 and inserting and pulling one end of sling 19 through an aperture in end 104 to choke the sling 19 around the elevated structure 15. Sling 19 is attached to swivel means 18 by inserting pin 108 through an aperture in metal tube casing 92 and aperture 106 of sling 19. Sling 19 is preferably a nylon strap. However, sling 19 could be a nylon rope, a chain, or a cord such as aircraft cable.

Alternatively, the attachment means could comprise an eyebolt that may be bolted to the elevated structure 15, and a safety hook that is connected to support rope 14. Support rope 14 could also be directly attached to support structure 15, by for example looping rope 14 over a tree branch or backstop of baseball diamond and tying a knot in support rope 14. However, this mode of attachment is not preferred, as it would require the user to periodically unwind support rope 14 after making a number of rotations about its longitudinal axis.

The present invention is deployed in the following manner. To ride ropeboard 12, a user first grabs hold of handle 16 with one hand and grabs ropeboard 12 in the other hand. The user then runs in a direction that pulls support rope 14 away from the vertical, with handle 16 and ropeboard 12 in hand, until user is lifted off the ground. The user then places their feet on platform 20, with one foot on front portion 30 and one foot on back portion 32, so that the user is standing in a generally upright position on the platform 20 and is holding onto handle 16 with one or both hands. Much like a swing, the user now needs to "pump" the ropeboard 12 by shifting his body weight at the apex of the swing to swing higher. This is accomplished more efficiently than a regular swing due to the fact that the user is standing and has handle 16 for support.

Once the user has learned to "pump" and swing, the user can do a large variety of stunts and tricks at each apex of the swing as well as at all points in between. Stunts and tricks include performing rotations of ropeboard 12 about longitudinal rope axis A and flips or rotations of ropeboard 12 about longitudinal platform axis B and combinations of both.

To "flip" or rotate the ropeboard 12 about longitudinal platform axis B, the user standing on the ropeboard 12 first holds on to handle 16 then lifts his or her feet off ropeboard 12, while applying a torque with one or both feet or a hand to one side of platform 20 to cause ropeboard 12 to flip or spin about shaft 24.

Ropeboard apparatus 10 may be used in conjunction with various structures such as rails or launching structures that are provided within the radius created by the length of support rope 14 and the point of attachment for support rope 14 such that ropeboard 12 can be supported on these structures. Various stunts and tricks such as "grind" and "stall" may be performed by the user by landing and sliding the ropeboard 12 on rails. Other elevated structures may be provided as launching structures. With ropeboard 12 supported on a launching structure, users can stand on ropeboard 12 with their hands holding handle 16 and start the swing by jumping off the elevated launching structure. The use of the elevated launching structure reduces the amount of effort initially required by users to "pump" the ropeboard 12 to achieve higher apexes in the swing.

Various other modifications of the preferred embodiments are possible. Bearing 27 could take the form of a roller bearing or the other type of bearing. Support rope 14 could take the form of an elastic cord such as a bungee cord, which would permit users to launch the ropeboard 12 from high elevations because of the bungee cord's shock absorbing characteristics.

It should therefore be apparent to one skilled in the art that various modifications can be made to the embodiments disclosed herein, without departure from the invention, the scope of which is defined in the appended claims.

The invention claimed is:

1. Apparatus for ropeboarding, comprising:

a) a support rope having a first end for attachment to an elevated structure and a second end; and b) a ropeboard, the ropeboard comprising an elongated platform having a longitudinal platform axis and a top surface shaped for a user to stand thereon, and a coupler for rotatably coupling the platform to the second end of the support rope so that the platform can be rotated about the longitudinal platform axis by the user while the platform is suspended from the support rope; the coupler comprises a shaft rigidly connected to the platform and oriented along the longitudinal platform axis; the shaft having a first end, a second end, and a middle portion; and a connector rotatably coupled to the middle portion of the shaft for connecting the platform to the support rope.

2. The apparatus defined in claim 1, further comprising attachment means for attaching the support rope to the elevated structure.

3. The ropeboard apparatus defined in claim 2, wherein the attachment means comprises swivel means for enabling the support rope to swivel about a longitudinal rope axis and fastening means for fastening the swivel means to the elevated structure.

4. The ropeboard apparatus defined in claim 3, wherein the swivel means comprises a universal joint and the fastening means comprises a sling.

5. The apparatus of claim 1, further comprising a handle attached to the support rope at a location above the ropeboard.

6. The apparatus of claim 5, wherein the handle comprises adjustment means for adjustably connecting the handle to the support rope at different locations above the ropeboard.

7. The ropeboard defined in claim 1, wherein the connector comprises a bearing portion rotatably mounted on the shaft and a rope connecting portion shaped for receiving the support rope.

8. The ropeboard defined in claim 7, wherein the bearing portion comprises a bearing having an inside race rigidly secured to the shaft and an outside race, and the rope connecting portion comprises a sleeve rigidly secured to the outside race having an aperture shaped for receiving the support rope.

9. The ropeboard defined in claim 7, wherein the rope connecting portion comprises a quick release connector having an outer tubular member shaped to slidingly engage an inner tubular member.

10. A ropeboard, comprising:

a) an elongated platform having a longitudinal platform axis and a top surface shaped for a user to stand thereon, the platform comprising a front board portion and a back board portion spaced therefrom, and a shaft rigidly connecting the front board portion to the back board portion, the shaft extending along the longitudinal platform access; and b) a connector rotatably coupled to the shaft for connecting the platform to a support rope so that the platform can be rotated about the longitudinal platform axis by the user, while the platform suspended from the support rope.

11. The ropeboard of claim 10, wherein the connector comprises a bearing portion rotatably mounted on the shaft and a rope connecting portion shaped for receiving the support rope.

12. The ropeboard defined in claim 11, wherein the bearing portion comprises a bearing having an inside race rigidly secured to the shaft and an outside race, and the rope connecting portion comprises a sleeve rigidly secured to the outside race having an aperture shaped for receiving the support rope.

13. The ropeboard defined in claim 12, wherein the front portion and the back portion of the platform have middle portions with generally flat top surfaces.

14. A ropeboard, comprising:

a) an elongated platform having a longitudinal platform axis and a top surface shaped for a user to stand thereon;

b) a shaft rigidly connected to the platform and oriented along the longitudinal platform axis; and c) a connector rotatably coupled to the shaft for connecting the platform to a support rope;

d) wherein the connector comprises a bearing portion rotatably mounted on the shaft and a rope connecting portion shaped for receiving the support rope.

15. The ropeboard defined in claim 14, wherein the shaft is mounted to the platform at the center of gravity thereof.

16. The ropeboard defined in claim 14, wherein the connector comprises a body made of a plastic material designed for sliding applications between metal and plastic.

17. The ropeboard defined in claim 16, wherein the body comprises a bearing portion having a shaft aperture sized to allow the shaft to rotate freely therein, and a rope connecting portion having a rope aperture shaped for receiving the support rope.

18. The ropeboard defined in claim 17, wherein the rope connecting portion comprises an eccentric lobe portion of the body.

19. The ropeboard defined in claim 14, wherein the platform comprises a front portion and a back portion, and wherein the shaft connects the front portion to the back portion.

20. The ropeboard defined in claim 19, wherein the shaft comprises a cylindrical tube.

21. The ropeboard defined in claim 19, wherein the front portion and the back portion of the platform have middle portions with generally flat top surfaces.

* * * * *